US009843100B2

(12) United States Patent
Lee et al.

(10) Patent No.: US 9,843,100 B2
(45) Date of Patent: Dec. 12, 2017

(54) ANTENNA HAVING BROAD BANDWIDTH AND HIGH RADIATION EFFICIENCY

(71) Applicants: SAMSUNG ELECTRONICS CO., LTD., Suwon-si (KR); SNU R&DB Foundation, Seoul (KR)

(72) Inventors: Jae Sup Lee, Yongin-si (KR); Seong Joong Kim, Suwon-si (KR); Sang Wook Nam, Seoul (KR); Su Min Yun, Incheon (KR)

(73) Assignees: Samsung Electronics Co., Ltd., Suwon-si (KR); SNU R&DB FOUNDATION, Seoul (KR)

( * ) Notice: Subject to any disclaimer, the term of this patent is extended or adjusted under 35 U.S.C. 154(b) by 106 days.

(21) Appl. No.: 13/680,313

(22) Filed: Nov. 19, 2012

(65) Prior Publication Data

US 2013/0194146 A1 Aug. 1, 2013

(30) Foreign Application Priority Data

Jan. 26, 2012 (KR) ..... 10-2012-0007886

(51) Int. Cl.

| | |
|---|---|
| ***H01Q 13/10*** | (2006.01) |
| ***H01Q 1/38*** | (2006.01) |
| ***H01Q 1/24*** | (2006.01) |
| ***H01Q 13/16*** | (2006.01) |
| ***H01Q 13/18*** | (2006.01) |
| ***H01Q 5/371*** | (2015.01) |
| ***H01Q 5/50*** | (2015.01) |

(52) U.S. Cl.

CPC ..... *H01Q 13/106* (2013.01); *H01Q 1/243* (2013.01); *H01Q 1/38* (2013.01); *H01Q 5/371* (2015.01); *H01Q 5/50* (2015.01); *H01Q 13/16* (2013.01); *H01Q 13/18* (2013.01)

(58) Field of Classification Search

USPC ..... 343/767

See application file for complete search history.

(56) References Cited

U.S. PATENT DOCUMENTS

2002/0158722 A1 10/2002 Maruhashi et al.
2010/0245049 A1* 9/2010 Yoshida et al. ..... 340/10.1

FOREIGN PATENT DOCUMENTS

| | | | |
|---|---|---|---|
| CN | 101682114 | A | 3/2010 |
| EP | 2 144 329 | A1 | 1/2010 |
| JP | 6-252631 | A | 9/1994 |
| JP | 11-186838 | | 7/1999 |
| JP | 2002-290144 | A | 10/2002 |
| JP | 2005-341320 | A | 12/2005 |

(Continued)

OTHER PUBLICATIONS

Extended European Search Report dated Oct. 16, 2013 in the counterpart European Application No. 13152174.2 (6 pages, in English).

(Continued)

*Primary Examiner* — Graham Smith
(74) *Attorney, Agent, or Firm* — NSIP Law

(57) ABSTRACT

An antenna having a broad bandwidth and a high radiation efficiency is provided. The antenna includes a conductor, and a dielectric substrate disposed on the conductor. The antenna further includes a slot portion formed on the dielectric substrate, and a cavity formed in the dielectric substrate that corresponds to the slot portion.

14 Claims, 6 Drawing Sheets

(56) References Cited

FOREIGN PATENT DOCUMENTS

| | | | |
|---|---|---|---|
| JP | 2008-167158 | A | 7/2008 |
| KR | 10-0601768 | B1 | 7/2006 |

OTHER PUBLICATIONS

Japanese Office Action dated Dec. 6, 2016 in corresponding Japanese Patent Application No. 2013-013717 (5 pages with English translation).
Vallecchi et al., Investigation of microstrip-fed slot antennas backed by shallow cavities, 2005 IEEE AP-S Digest, 2005, vol. 3B, pp. 373-376.
Singh, Ka-band micromachined microstrip patch antenna, IET Microwave Antennas and Propagation, 2010, vol. 4, No. 3, pp. 316-323 (document corresponding to the known art).
Wu Pan et al., Micromachined Patch Antennas on Synthesized Substrates, Proceedings 4th International Conference on Microwave and Millimeter Wave Technology, 2004, pp. 58-61 (document corresponding to the known art).
Sami Hage-Ali et al., Millimeter-wave patch antenna on ultra flexible micromachined Polydimethylsiloxane (PDMS) substrate, 2009 IEEE AP-S Digest, 2009, pp. 1-4 (document corresponding to the known art).
Pan Li-Na et al., Millimeter-wave Design and Fabrication of GaAs Micromachined Patch Antenna, 2012 IEEE MTT-S International Microwave Workshop Series on Millimeter Wave Wireless Technology and Applications, Proceeding of IMWS2012, 2012, pp. 1-3 (document corresponding to the known art).
Chinese Office Action dated Jan. 22, 2017 in corresponding Chinese Patent Application No. 201310011425.8 (16 pages with English translation).

* cited by examiner

ANTENNA HAVING BROAD BANDWIDTH AND HIGH RADIATION EFFICIENCY

CROSS-REFERENCE TO RELATED APPLICATION(S)

This application claims the benefit under 35 U.S.C. §119(a) of Korean Patent Application No. 10-2012-0007886, filed on Jan. 26, 2012, in the Korean Intellectual Property Office, the entire disclosure of which is incorporated herein by reference for all purposes.

BACKGROUND

1. Field

The following description relates to an antenna having a broad bandwidth and a high radiation efficiency.

2. Description of Related Art

A slot antenna includes a metal surface, such as a flat plate, with a hole or slot cut out. When the plate is driven as an antenna by a driving frequency, the slot radiates electromagnetic waves.

For a slot antenna to include a wide bandwidth, a width of a slot may be increased. However, when a conductor is disposed at a back surface of the slot antenna including a low height, the width of the slot may be larger than a height of a substrate of the slot antenna. In this example, the bandwidth may not be effectively increased.

SUMMARY

In one general aspect, there is provided an antenna including a conductor, and a dielectric substrate disposed on the conductor. The antenna further includes a slot portion formed on the dielectric substrate, and a cavity formed in the dielectric substrate that corresponds to the slot portion.

In another general aspect, there is provided an antenna including a conductor, and a dielectric substrate disposed on the conductor. The antenna further includes a slot portion formed on the dielectric substrate. A portion of the dielectric substrate that corresponds to the slot portion is filled with air to reduce a permittivity of the slot portion.

In still another general aspect, there is provided an antenna including a dielectric substrate, and a conductive substrate disposed on the dielectric substrate. The antenna further includes a slot formed through the conductive substrate, and a hole formed in the dielectric substrate that corresponds to the slot.

Other features and aspects will be apparent from the following detailed description, the drawings, and the claims.

Figure 1:
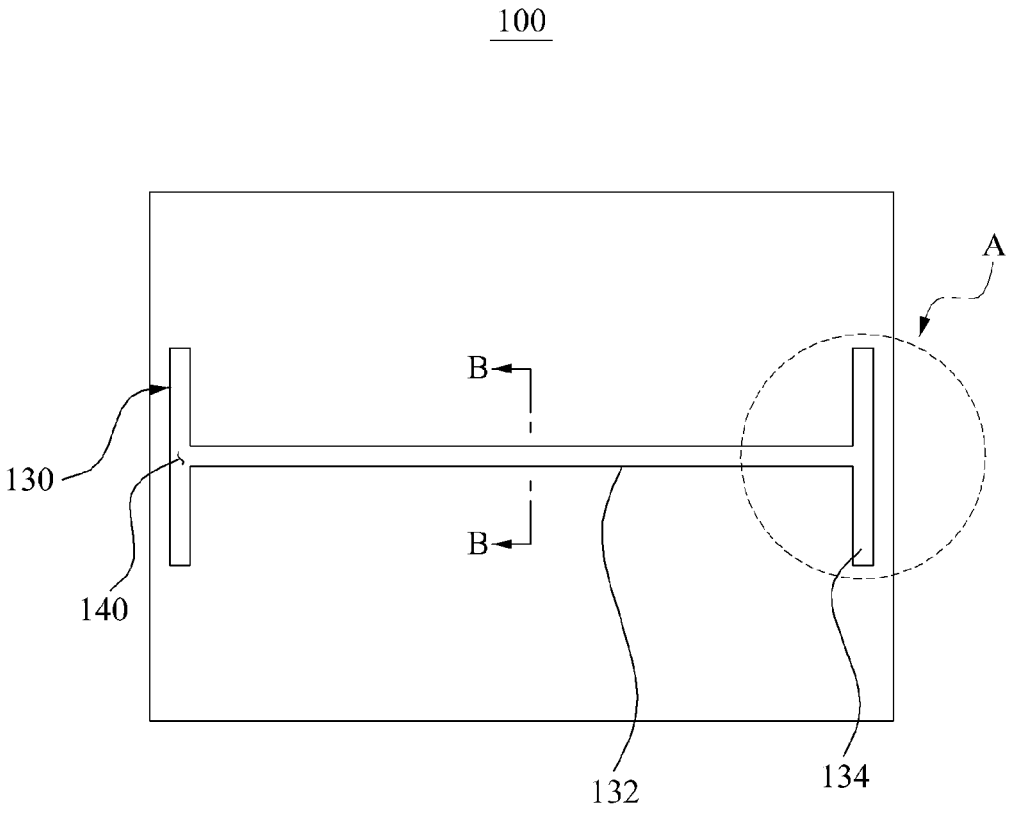
FIG. 1 is a plan view illustrating an example of a high-efficiency wide-bandwidth antenna.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, description of well-known functions and constructions may be omitted for increased clarity and conciseness.

It is understood that the features of the disclosure may be embodied in different forms and should not be constructed as limited to the example(s) set forth herein. Rather, example(s) are provided so that this disclosure will be thorough and complete, and will convey the full scope of the disclosure to those skilled in the art. The drawings may not be necessarily to scale, and, in some examples, proportions may have been exaggerated in order to clearly illustrate features of the example(s). When a first layer is referred to as being "on" a second layer or "on" a substrate, it may not only refer to a case where the first layer is formed directly on the second layer or the substrate but may also refer to a case where a third layer exists between the first layer and the second layer or the substrate.

Figure 2:
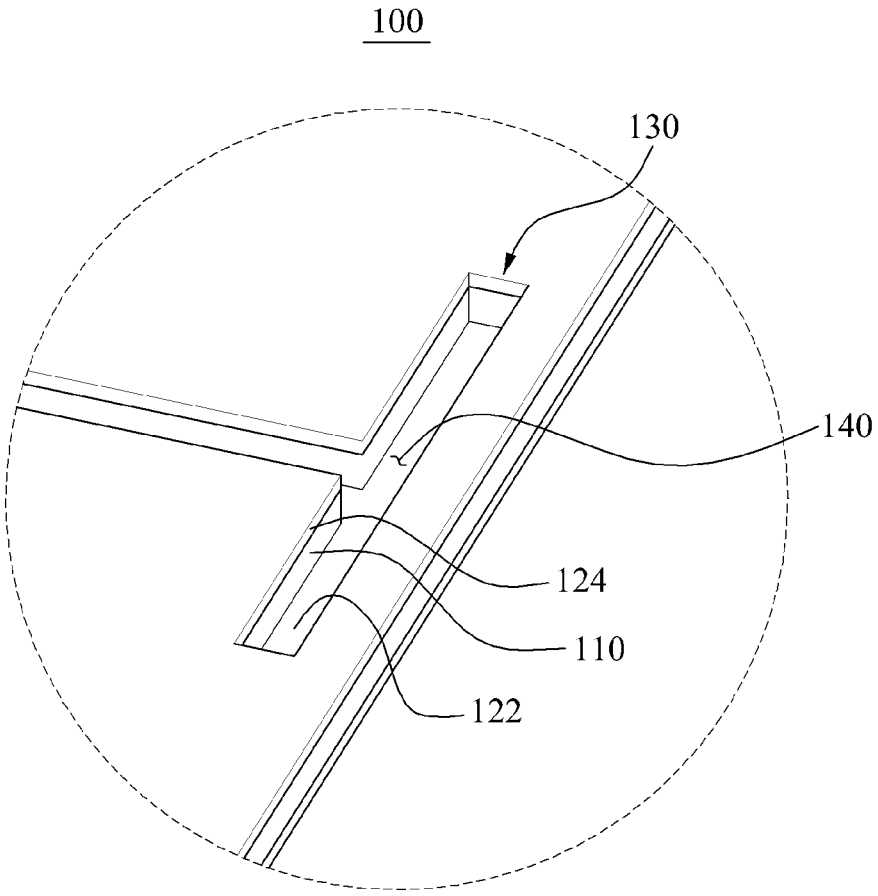
FIG. 2 is an enlarged perspective view illustrating an example of a portion A of the high-efficiency wide-bandwidth antenna of FIG. 1.

FIG. 1 is a plan view illustrating an example of a high-efficiency wide-bandwidth antenna 100. FIG. 2 is an enlarged perspective view illustrating an example of a portion A of the high-efficiency wide-bandwidth antenna 100 of FIG. 1. Referring to FIGS. 1 and 2, the high-efficiency wide-bandwidth antenna 100 includes a dielectric substrate 110, a lower conductor portion 122, an upper conductor portion 124, a slot portion 130, and a cavity portion 140.

The high-efficiency wide-bandwidth antenna 100 may be used on, and attached to, a human body. Since the human body may cause a great loss of a power of a transmitter, and may limit the power for safety, the high-efficiency wide-bandwidth antenna 100 is configured to achieve a high radiation efficiency and a wide bandwidth.

Accordingly, the high-efficiency wide-bandwidth antenna 100 includes a cavity-backed slot antenna including a relatively small thickness. The cavity-backed slot antenna includes a cavity formed to a back surface of the slot antenna, and is not greatly affected by electrical characteristics of a material on which the slot antenna is placed. Therefore, the cavity-backed slot antenna may be used in a system including a lossy medium, such as a ground surface or a human body disposed at the back surface of the slot antenna.

In more detail, the dielectric substrate 110 may include a substantially rectangular plate form, but a shape of the dielectric substrate 110 is not limited thereto. For example, the dielectric substrate 110 may include a polygonal or circular plate form.

The lower conductor 122 is disposed below a lower surface of the dielectric substrate 110, e.g., at the back surface of the cavity-backed slot antenna. The upper conductor 124 is disposed above an upper surface of the dielectric substrate 110.

The slot portion 130 is formed in (e.g., through) the upper conductor 124 and on the upper surface of the dielectric substrate 110. The slot portion 130 includes a slot (e.g., a trench) partially exposing the dielectric substrate 110. The dielectric substrate 110 is exposed by removing the upper conductor 124 in a predetermined pattern. The slot portion 130 may include a linearly extended portion including a length corresponding to about one half of a wavelength of a transmission wave.

As will be described in detail with reference to FIG. 3, the cavity portion 140 is formed in the dielectric substrate 110, under the slot portion 130, and on the lower conductor 122. The cavity portion 140 includes a cavity filled with air.

Figure 3:
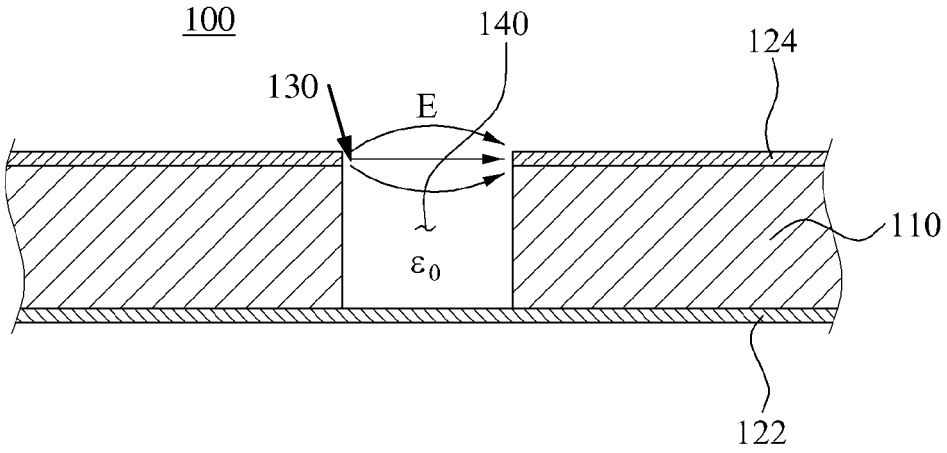
FIG. 3 is a sectional view illustrating an example of a section that is cut along a line B-B of the high-efficiency wide-bandwidth antenna of FIG. 1.

FIG. 3 is a sectional view illustrating an example of a section that is cut along a line B-B of the high-efficiency wide-bandwidth antenna 100 of FIG. 1. Referring to FIG. 3, the cavity portion 140 includes a cavity (e.g., a trench) formed by removing the dielectric substrate 110 disposed under the slot portion 130 through the upper surface of the dielectric substrate 110 and the lower surface of the dielectric substrate 110. That is, the cavity portion 140 is formed by removing a portion of the dielectric substrate 110 that corresponds to (e.g., is under and aligned with) the slot portion 130. The cavity portion 140 extends to a position (e.g., a depth) contacting the lower conductor 122 that includes the back surface of the cavity-backed slot antenna, to form the cavity of the high-efficiency wide-bandwidth antenna 100.

Alternatively, the cavity portion 140 may be formed through the upper surface of the dielectric substrate 110 and partially into the dielectric substrate 110 to a position (e.g., a depth) that does not contact the lower conductor 122. That is, the cavity portion 140 may be formed by removing a smaller portion of the dielectric substrate 110 that corresponds to (e.g., is under and aligned with) the slot portion 130 to reduce a size of the cavity. This may be achieved by using a high-permittivity substrate (e.g., FR-4) as the dielectric substrate 110.

Hereinafter, an increase in the radiation efficiency and the bandwidth of the high-efficiency wide-bandwidth antenna 100 due to the cavity portion 140 will be described in detail.

Figure 4:
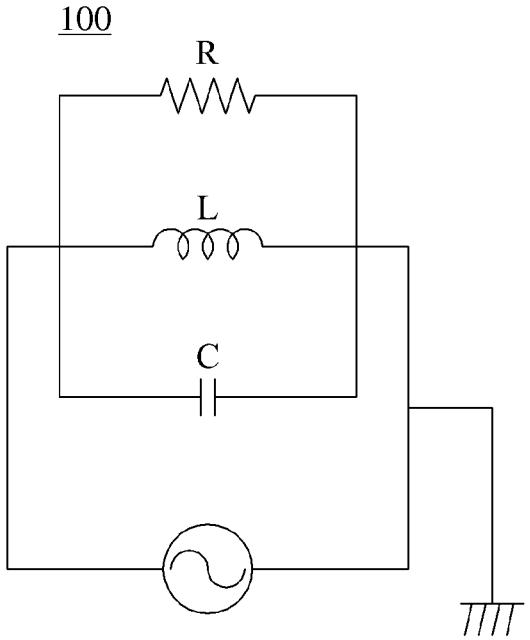
FIG. 4 is a diagram illustrating an example of an equivalent circuit of the high-efficiency wide-bandwidth antenna of FIG. 1.

FIG. 4 is a diagram illustrating an example of an equivalent circuit of the high-efficiency wide-bandwidth antenna 100 of FIG. 1. Referring to FIG. 4, the high-efficiency wide-bandwidth antenna 100 includes the cavity-backed slot antenna including a slot portion, e.g., the slot portion 130 of FIG. 1. The slot portion may include the length corresponding to about one half of the wavelength. The cavity-backed slot antenna may be implemented by a transmission circuit (e.g., a parallel RLC circuit as shown in FIG. 4) of about one quarter of the wavelength with a short-circuited end. Therefore, the cavity-backed slot antenna may include impedance characteristics similar to those of a parallel resonator.

A Q factor is a sharpness degree of a resonance of a tuning circuit. That is, the Q factor may be a multiple of a sum of voltages at both ends of an inductor or a capacitor in a serial resonator, or a multiple of a current flowing through the ends in a parallel resonator. A Q factor of a parallel resonator (e.g., the high-efficiency wide-bandwidth antenna 100) may be determined based on the example of Equation 1:

$$Q=\omega_0 CR \tag{1}$$

In Equation 1, Q denotes the Q factor, $\omega_0$ denotes a frequency at a time of a resonance of the parallel resonator, C denotes a capacitance of a capacitor in the parallel resonator, and R denotes a resistance of a resistor in the parallel resonator.

A bandwidth BW of the parallel resonator may be determined based on the example of Equation 2:

$$BW=1/Q=1/\omega_0 CR \tag{2}$$

Thus, since the capacitance C and the bandwidth BW are reciprocal values of each other, the bandwidth BW is increased as the capacitance C is reduced.

Referring again to FIG. 3, when the portion of the dielectric substrate 110 that is under and aligned with the slot portion 130 is removed, a permittivity of the slot portion 130 is reduced. That is, when the cavity portion 140 is formed, the air fills in the cavity portion 140. A permittivity $\in_0$ of the air is lower than a permittivity of the dielectric substrate 110. Accordingly, the permittivity of the slot portion 130 is reduced when the air fills the cavity portion 140 compared to when the dielectric substrate 110 fills the cavity portion 140. Therefore, the capacitance C of the high-efficiency wide-bandwidth antenna 100 is reduced.

Due to the reduction in the capacitance C, the Q factor Q of the high-efficiency wide-bandwidth antenna 100 is reduced. As a result, the bandwidth BW of the high-efficiency wide-bandwidth antenna 100 is increased.

In addition, a strong electric field E is generated in the slot portion 130. When the high-efficiency wide-bandwidth antenna 100 is used, a dielectric loss occurring at the dielectric substrate 110 is reduced, thereby increasing a radiation efficiency of the high-efficiency wide-bandwidth antenna 100.

By including the cavity portion 140, the high-efficiency wide-bandwidth antenna 100 includes the low capacitance C so that the wide bandwidth is achieved. The resonance frequency $\omega_0$ may be determined based on the example of Equation 3:

$$\omega_0=1/(LC)0.5 \tag{3}$$

In Equation 3, L denotes an inductance of an inductor in the parallel resonator. The capacitance C and the inductance L are inversely proportional to each other. That is, in order to constantly maintain the resonance frequency $\omega_0$, the inductance L is increased by as much as the capacitance C is reduced. The inductance L is increased by increasing the length of the slot portion 130.

Referring again to FIG. 1, the slot portion 130 includes a first slot 132 extending from a center of the high-efficiency wide-bandwidth antenna 100 to opposite outer sides of the high-efficiency wide-bandwidth antenna 100 in a symmetrical shape, and second slots 134 extending from both respective ends of the first slot 132. Therefore, the slot portion 130 includes an H shape. That is, the length of the slot portion 130 is increased by as much as the second slots 132 formed at the respective ends of the first slot 132. Thus, the inductance L of the high-efficiency wide-bandwidth antenna 100 is increased, thereby compensating for the reduced capacitance C of the high-efficiency wide-bandwidth antenna 100.

Figure 5:
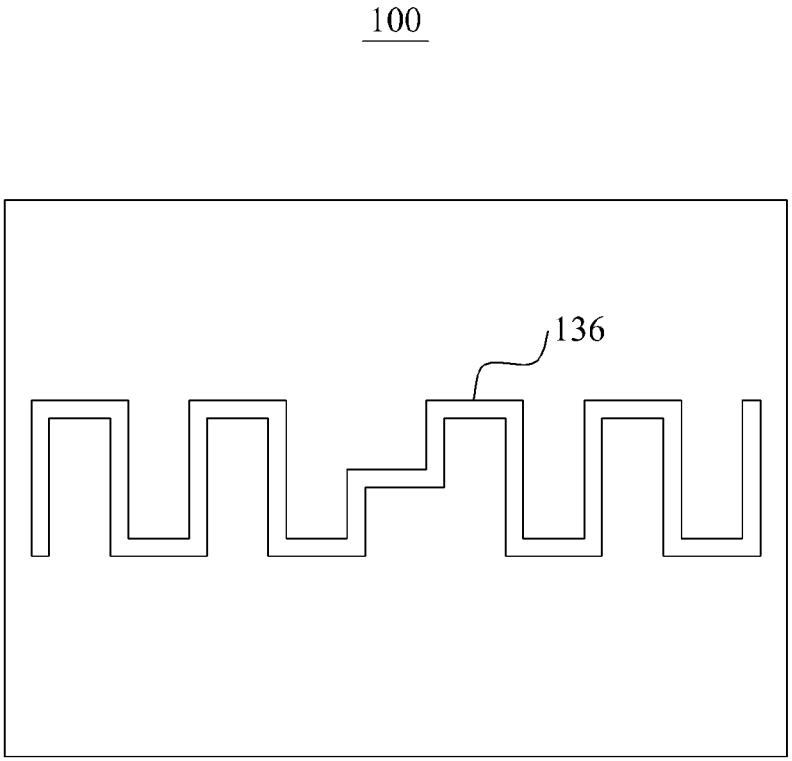
FIG. 5 is a plan view illustrating an example of the high-efficiency wide-bandwidth antenna of FIG. 1 that includes a meandering slot portion.

FIG. 5 is a plan view illustrating an example of the high-efficiency wide-bandwidth antenna 100 of FIG. 1 that includes a meandering slot portion 136. Referring to FIG. 5, the meandering slot portion 136 extends from the center of the high-efficiency wide-bandwidth antenna 100 to the opposite outer sides of the high-efficiency wide-bandwidth antenna 100 in a symmetrical shape.

The meandering slot portion 136 includes a length that is increased from the length of the slot portion 130 of FIGS. 1 through 3. Accordingly, the inductance L of the high-efficiency wide-bandwidth antenna 100 is increased, thereby compensating for the reduction in the capacitance C of the high-efficiency wide-bandwidth antenna 100.

Alternatively, a slot portion of the high-efficiency wide-bandwidth antenna 100 may extend symmetrically from the center to the opposite outer sides in a zigzag shape, a wave shape, and/or a step shape. Although the slot portions 130 and 136 of FIGS. 1 through 3 and 5 include the H shape and the meandering shape, respectively, the shape of the slot portion is not limited thereto. Therefore, any other shape is applicable as far as the shape increases a length of the slot portion, and increases the inductance L to compensate for the reduction in the capacitance C.

Figure 6:
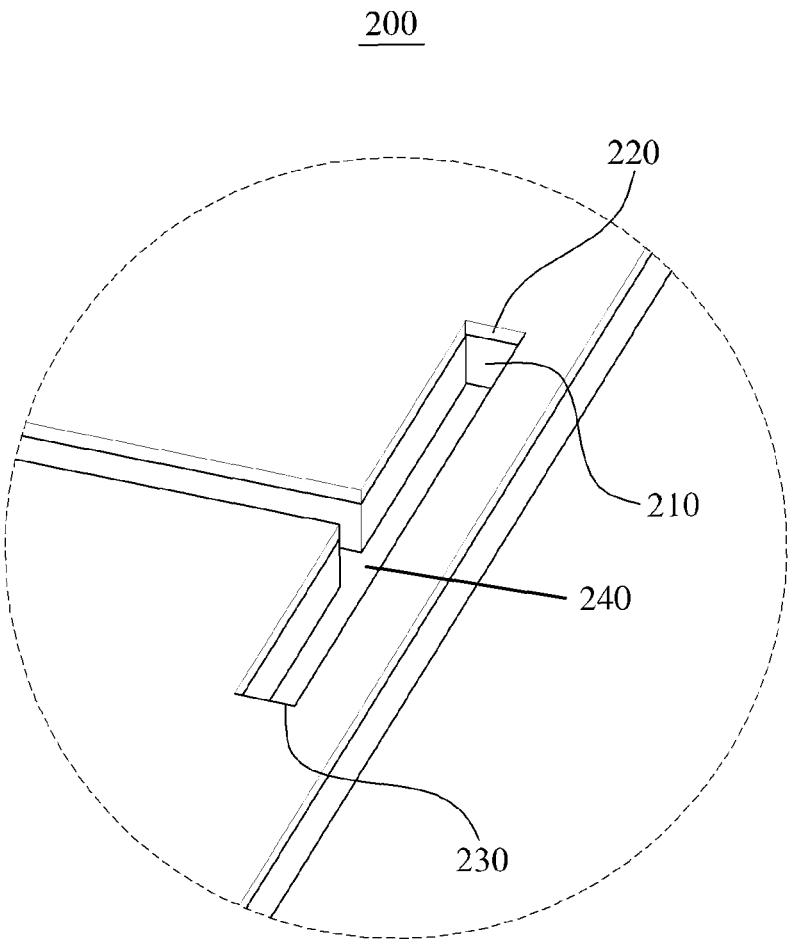
FIG. 6 is a partial perspective view illustrating another example of a high-efficiency wide-bandwidth antenna.

FIG. 6 is a perspective view illustrating another example of a high-efficiency wide-bandwidth antenna 200. Referring to FIG. 6, the high-efficiency wide-bandwidth antenna 200 includes a dielectric substrate 210, a conductive substrate 220, a slot portion 230, and a hole portion 240.

The conductive substrate 220 is disposed on an upper surface of the dielectric substrate 210. The slot portion 230 is formed in the conductive substrate 220 and on the upper surface of the dielectric substrate 210.

A hole portion 240 is formed in the dielectric substrate 210 and under the slot portion 230, and is filled with air. The hole portion 240 is formed by removing a portion of the dielectric substrate 210 that corresponds to (e.g., is under and aligned with) the slot portion 230. In contrast to the high-efficiency wide-bandwidth antenna 100, the high-efficiency wide-bandwidth antenna 200 does not include a dedicated conductive substrate disposed below the dielectric substrate 210 and that includes a back surface of the high-efficiency wide-bandwidth antenna 100.

As the portion of the dielectric substrate 210 is removed and filled with air, a permittivity of the slot portion 230 is reduced, and therefore, a capacitance of the high-efficiency wide-bandwidth antenna 200 is reduced. A bandwidth of the high-efficiency wide-bandwidth antenna 200 is increased due to the reduction in the capacitance.

In addition, a strong electric field is generated in the slot portion 230. When the high-efficiency wide-bandwidth antenna 200 is used, a dielectric loss occurring at the dielectric substrate 210 is reduced, thereby increasing a radiation efficiency of the high-efficiency wide-bandwidth antenna 200.

Referring to FIG. 6, the hole portion 240 is a via formed through the upper surface of the dielectric substrate 210 and a lower surface of the dielectric substrate 210. Alternatively, the hole portion 240 may be a cavity (e.g., a trench) formed through the upper surface of the dielectric substrate 210 and partially into the dielectric substrate 210.

The slot portion 230 may include a meandering shape or an H shape to increase a length of the slot portion 230, thereby increasing an inductance of the high-efficiency wide-bandwidth antenna 200 that corresponds to the reduced capacitance.

An experiment has been performed to compare a bandwidth and a radiation efficiency between a general cavity-backed slot antenna and the high-efficiency wide-bandwidth antenna 100 or 200 of FIGS. 1 through 6. Results of the experiment are shown below.

The experiment has been performed on a presumption that each antenna is placed on a human body, and that a model of the human body includes a permittivity $\in_r$ of about 35.15, a conductivity σ of about 1.16 siemens per meter (S/m), and a size of about 100×100×30 millimeters (mm) A width of a slot portion of each antenna has been set to about 1 mm Three different types RT 6010, RT 5800, and FR-4 of a substrate of each antenna has been used. Three different heights of each antenna, that is, 1 mm, 2 mm, and 3 mm, have been applied. Under the aforementioned conditions, the bandwidth and the radiation efficiency have been measured.

Experimental Example 1

In experimental example 1, a substrate RT 5880 has been used, of which a permittivity is 2.2 and a loss tangent is 0.0009. Results of the experimental example 1 are shown below:

| | Bandwidth(MHz) | | Rad. Eff. (%) | |
|---|---|---|---|---|
| | Not applied | applied | Not applied | applied |
| 1 mm | 26.6 | 29 | 75.5 | 76.3 |
| 2 mm | 38.9 | 48.8 | 81.8 | 82.6 |
| 3 mm | 50.6 | 62.9 | 84 | 84.3 |

According to the results of experimental example 1, comparing the general cavity-backed slot antenna (not applied) with the high-efficiency wide-bandwidth antenna (applied) at the various heights of the antennas, the bandwidth and the radiation efficiency are both increased in the high-efficiency wide-bandwidth antenna irrespective of the heights of the antennas.

Experimental Example 2

In experimental example 2, a substrate RT 6010 has been used, of which a permittivity is 10.2 and a loss tangent is 0.0023. Results of the experimental example 2 are shown below:

| | Bandwidth(MHz) | | Rad. Eff. (%) | |
|---|---|---|---|---|
| | Not applied | applied | Not applied | applied |
| 1 mm | 14.4 | 16.5 | 38 | 38.4 |
| 2 mm | 16.5 | 24.2 | 46.4 | 49.5 |
| 3 mm | 18.8 | 28 | 51.6 | 54.5 |

According to the results of experimental example 2 comparing the general cavity-backed slot antenna (not applied) with the high-efficiency wide-bandwidth antenna (applied) at the various heights of the antennas, the bandwidth and the radiation efficiency are both increased in the high-efficiency wide-bandwidth antenna irrespective of the heights of the antennas.

Experimental Example 3

In experimental example 3, a substrate FR-4 has been used, of which a permittivity is 10.2 and a loss tangent is 0.0023. Results of the experimental example 3 are shown below:

| | Bandwidth(MHz) | | Rad. Eff. (%) | |
|---|---|---|---|---|
| | Not applied | applied | Not applied | applied |
| 1 mm | 35.2 | 37 | 31.5 | 34.3 |
| 2 mm | 39.1 | 48.5 | 41.4 | 48.2 |
| 3 mm | 46.4 | 56.7 | 47.6 | 55.4 |

According to the results of experimental example 3, comparing the general cavity-backed slot antenna (not applied) with the high-efficiency wide-bandwidth antenna (applied) at the various heights of the antennas, the bandwidth and the radiation efficiency are both increased in the high-efficiency wide-bandwidth antenna irrespective of the heights of the antennas.

As can be appreciated from the experimental examples, both the bandwidth and the radiation efficiency are increased in the high-efficiency wide-bandwidth antenna. In addition, the height and a size (e.g., of a cavity) of the high-efficiency wide-bandwidth antenna may be reduced.

According to the teachings above, there is provided an antenna that achieves a high radiation efficiency and a wide bandwidth. To achieve such characteristics, a dielectric of the antenna is removed from below a slot to form a cavity, and accordingly, the antenna includes a low height. In addition, the dielectric may include a high-permittivity substrate to reduce a size of the cavity.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A slot antenna comprising:

a dielectric substrate disposed between a first conductor and a second conductor;

the second conductor, defining a slot antenna configuration having a slot portion formed on the dielectric substrate and exposing a corresponding surface portion of the first conductor, the second conductor further having a first surface and an opposing second surface, the first surface being contiguously disposed on the dielectric substrate, and the second surface defining an outer surface of the slot antenna; and a cavity formed in the dielectric substrate that corresponds to the slot portion, wherein the slot portion extends across the second conductor and terminates at opposite outer sides of the second conductor with a transverse slot portion, and wherein the slot antenna with the cavity formed in the dielectric substrate has a greater bandwidth than a bandwidth of another slot antenna without a cavity, formed on a dielectric substrate, corresponding to a slot portion of the slot antenna.

2. The slot antenna of claim 1, wherein the dielectric substrate comprises a high-permittivity substrate.

3. The slot antenna of claim 1, wherein the cavity is aligned with the slot portion.

4. A slot antenna comprising:

a dielectric substrate disposed between a first conductor and a second conductor;

the second conductor, defining a slot antenna configuration having a slot portion formed on the dielectric substrate, the second conductor further having a first surface and an opposing second surface, the first surface being contiguously disposed on the dielectric substrate, and the second surface defining an outer surface of the slot antenna; and a cavity formed in the dielectric substrate that corresponds to the slot portion is filled with air to reduce a permittivity of the slot portion, wherein the slot portion extends across the second conductor and terminates at opposite outer sides of the second conductor with a transverse slot portion, and wherein the slot antenna with the cavity formed in the dielectric substrate has a greater bandwidth than a bandwidth of another slot antenna without a cavity, formed on a dielectric substrate, corresponding to a slot portion of the slot antenna.

5. The slot antenna of claim 4, wherein the portion of the dielectric substrate is formed through the dielectric substrate.

6. The slot antenna of claim 4, wherein the dielectric substrate comprises a high-permittivity substrate.

7. A slot antenna comprising:

a conductive substrate, defining a slot antenna configuration having a slot portion formed through the conductive substrate, and further having a first surface and an opposing second surface, the first surface being contiguously disposed on a dielectric substrate, and the second surface defining an outer surface of the slot antenna;

a hole formed through the dielectric substrate that corresponds to the slot portion, wherein the slot portion extends across the conductive substrate and terminates at opposite outer sides of the conductive substrate with a transverse slot portion, and wherein the slot antenna with the hole formed through the dielectric substrate has a greater bandwidth than a bandwidth of another slot antenna without a hole, formed through a dielectric substrate, corresponding to a slot portion of the slot antenna.

8. The slot antenna of claim 7, wherein the dielectric substrate comprises a high-permittivity substrate.

9. The slot antenna of claim 7, wherein the slot portion has a meandering shape or an H shape.

10. The slot antenna of claim 7, wherein:

the hole is formed through another surface of the antenna.

11. The slot antenna of claim 1, wherein a surface of the second conductor is a surface of the antenna.

12. The slot antenna of claim 1, wherein the slot portion extends from a center of the second conductor to the opposite outer sides of the second conductor in a symmetrical shape.

13. The slot antenna of claim 1, wherein the slot portion has an H shape.

14. The slot antenna of claim 1, wherein the slot portion extends symmetrically from a center of the second conductor to the opposite outer sides of the second conductor in a meandering shape, a zigzag shape, a wave shape, a step shape, or any combination thereof.

* * * * *